United States Patent [19]

Radtke

[11] 3,990,812

[45] Nov. 9, 1976

[54] RADIAL INFLOW BLADE COOLING SYSTEM

[75] Inventor: Leland J. Radtke, North Palm Beach, Fla.

[73] Assignee: United Technologies Corporation, Hartford, Conn.

[22] Filed: Mar. 3, 1975

[21] Appl. No.: 554,995

[52] U.S. Cl. ..... 416/95; 416/97 A; 415/115

[51] Int. Cl.[2] ..... F01D 5/18

[58] Field of Search ..... 416/95–97, 416/92; 415/115–116, 178, 180

[56] References Cited

UNITED STATES PATENTS

| | | | |
|---|---|---|---|
| 2,738,949 | 3/1956 | Wilkinson | 415/180 X |
| 2,951,340 | 9/1960 | Howald | 416/95 X |
| 3,565,545 | 2/1971 | Bobo et al. | 416/95 X |
| 3,602,605 | 8/1971 | Lee et al. | 415/116 |
| 3,712,756 | 1/1973 | Kalikow et al. | 416/95 X |
| 3,768,921 | 10/1973 | Brown et al. | 415/116 |
| 3,814,539 | 6/1974 | Klompas | 416/95 |
| 3,832,090 | 8/1974 | Matto | 416/95 |

FOREIGN PATENTS OR APPLICATIONS

| | | | |
|---|---|---|---|
| 1,194,663 | 6/1970 | United Kingdom | 415/115 |

*Primary Examiner*—Everette A. Powell, Jr.
*Attorney, Agent, or Firm*—Jack N. McCarthy

[57] ABSTRACT

An engine is shown having a system for providing cooling fluid flowing radially inward to turbine blades on a disk while providing sealing means between the blade roots and cooperating disk slots and providing means for retaining the turbine blades on their disk. The cooling system includes stationary passageway means for directing a coolant flow from a source through an annular axial passageway where it is given a swirling velocity in the direction of rotation in the bladed rotor by means of grooves. The cooling fluid is then discharged from substantially radial passageways in the stationary passageway which are directed at an angle so that the coolant peripheral velocity essentially matches that of the rotating shaft on which the bladed rotor is located. Openings in the rotating shaft located radially inward from the substantially radial passageways in the stationary passageway means permit this flow to enter an annular passageway in this member where it is directed to the blades. Cooling air is injected at the inner diameter of a full ring coverplate and is directed to a hole in each of the small coverplates which permits the cooling air to enter the inside of the hollow blade.

2 Claims, 4 Drawing Figures

RADIAL INFLOW BLADE COOLING SYSTEM

The invention herein described was made in the course of or under a contract or subcontract with the Department of the Army.

BACKGROUND OF THE INVENTION

This invention relates to turbine rotor coolant delivery means, particularly for use in a gas turbine engine.

An engine of this size is discussed in U.S. Pat. No. 3,749,514.

The specific blade sealing and retaining means is claimed in U.S. application Ser. No. 453,441, now U.S. Pat. No. 3,936,216.

SUMMARY OF THE INVENTION

A primary object of the present invention is to provide means for directing cooling air into turbine rotor parts while providing a minimum disturbance to the gas pressure induced thrust forces acting on the rotor system.

In accordance with the present invention an annular fixed passageway has a spiral groove to give a swirling velocity to a cooling fluid in the direction of roatation of a shaft on which a bladed rotor is mounted. Angular passageways discharge the coolant into passageways in the rotating shaft such that the coolant peripheral velocity essentially matches that of the rotating member.

An object of this invention is to provide a radial inflow blade cooling system which will avoid placing appreciable thrust loads on the rotor. The radial flow direction between the stationary and rotating member permits this by utilizing radial labyrinth seals (which are approximately the same diameter) on both sides of the space between the stationary and rotating members.

DESCRIPTION OF THE PREFERRED EMBODIMENT

Figure 1:
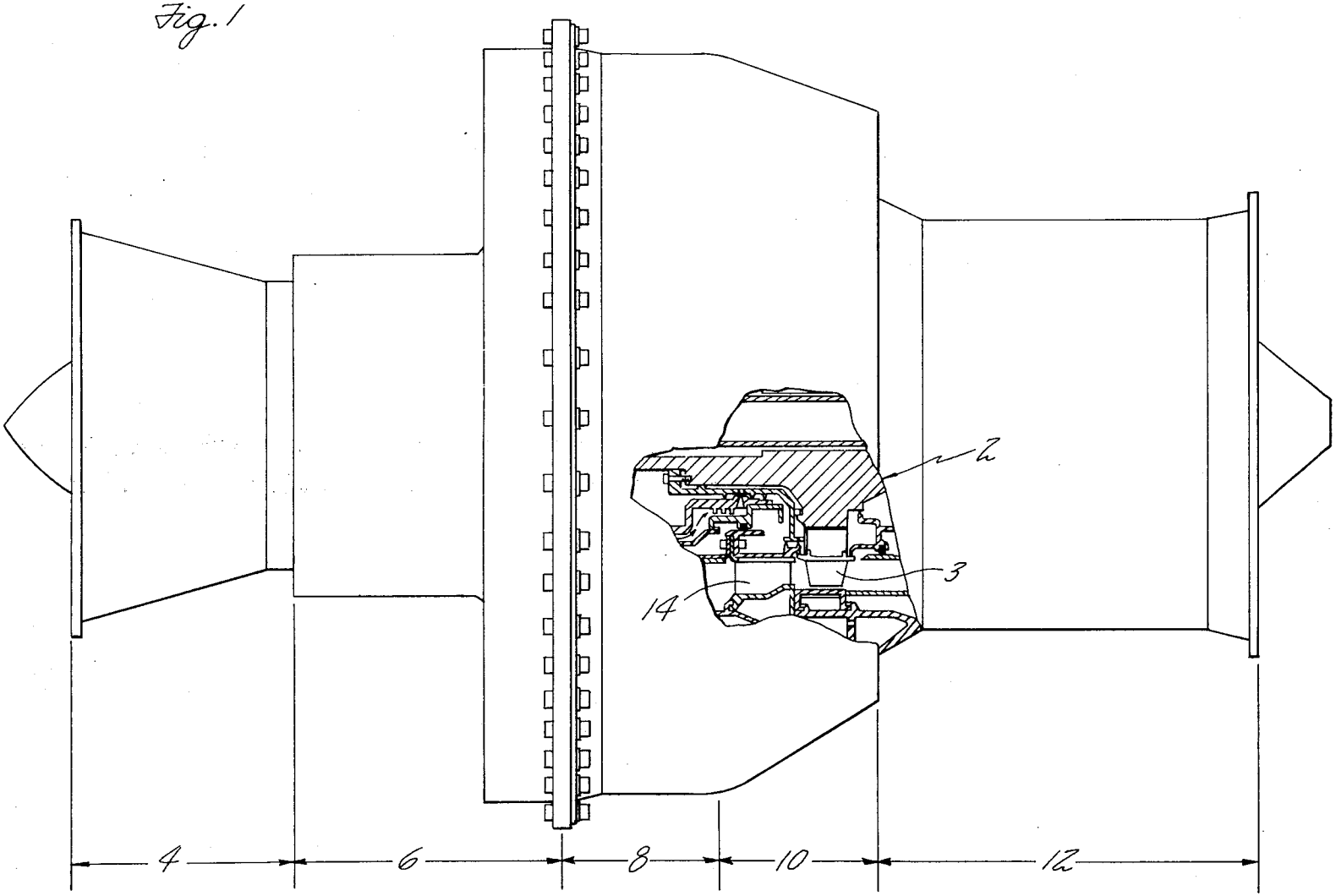
FIG. 1 is an external side view of an engine with a section broken away to show the location of the invention.
Figure 2:
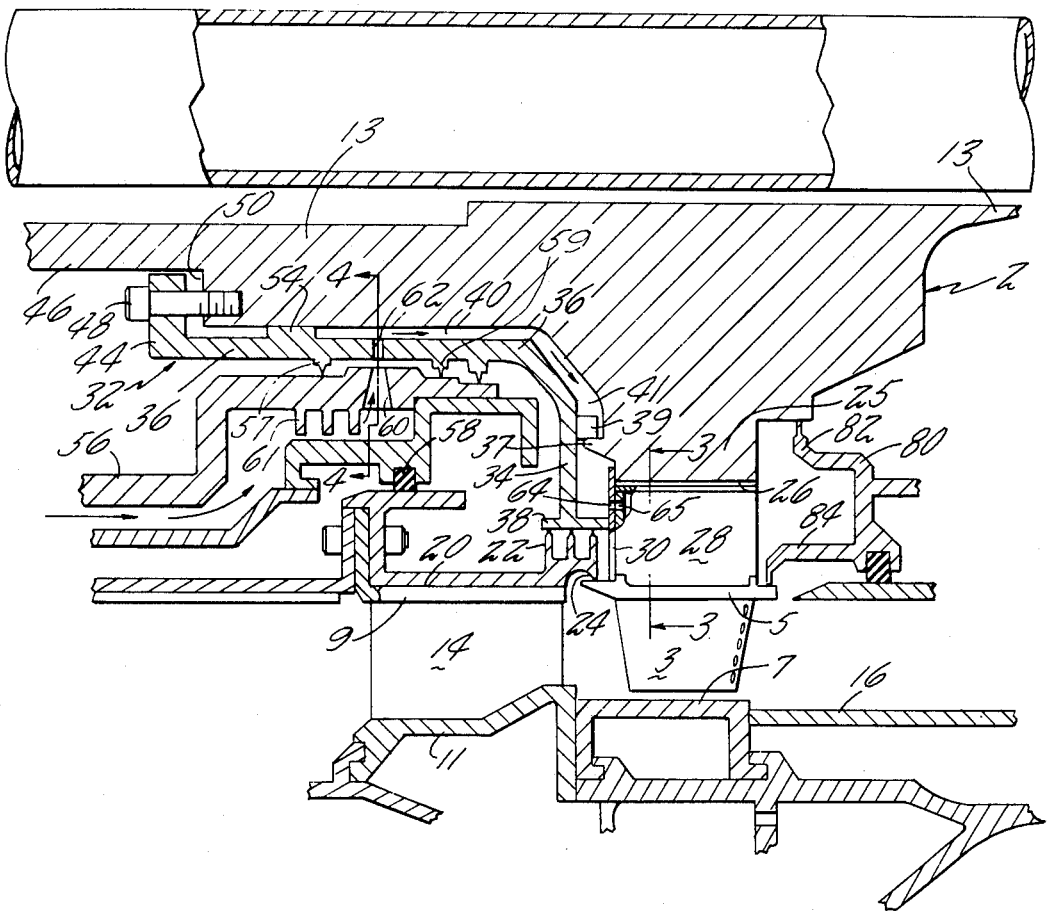
FIG. 2 is an enlarged view of the radial inflow blade cooling system of FIG. 1.
Figure 4:
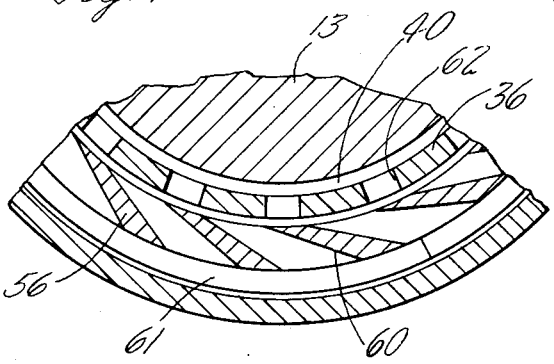
FIG. 4 is a view taken along the line 4—4 of FIG. 2.
Figure 3:
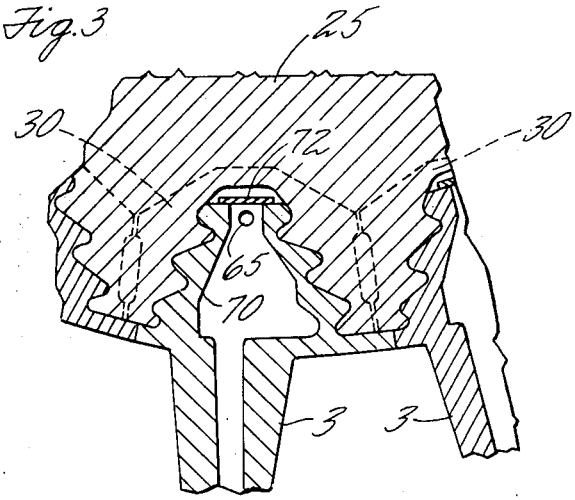
FIG. 3 is a view taken along the line 3—3 of FIG. 2.

Referring to FIG. 1, engine 1 is shown having an inlet section 4, a compressor section 6, combustion section 8, a turbine section 10 and an exhaust section 12. The turbine section 10 has a rotor assembly 2 with a shaft 13 mounted for rotation on bearings (not shown) within the engine 1. Rotor assembly 2 includes turbine blades 3 for receiving a gas flow from the combustion section 8, said gases passing over vanes 14. The vanes 14 have inner and outer annular shrouds 9 and 11, respectively, defining an annular passageway connected to said combustion section for delivering a fluid flow therefrom to said blades 3. Blades 3 are located between an inner rotating annular member 5 formed by the blade platforms and an outer shroud member 7 formed by a blade tip sealing means. One modification of a blade tip sealing means is shown in U.S. Pat. No. 3,742,705. Fluid from the blades is directed to the exhaust section 12 by an exhaust duct 16.

Outer shroud 11 is fixed to the housing of turbine section 10 while the inner shroud 9 is fixedly positioned by the vanes 14. An annular sealing member 20 is fixed to the inner shroud 9 and includes annular sealing edges 22 which extend inwardly for sealing cooperation with a rotating cylindrical surface which will be hereinafter described. Said annular sealing member 20 also has an outwardly extending sealing edge 24 which performs a sealing function with the forward inner surface formed by the blade platforms.

Rotor assembly 2 is formed having a disk 25 with slots 26 located around the periphery therof, each slot 26 receiving a root section 28 of a blade 3. A small coverplate 30 is fixed, such as by bonding, to the forward end of the root section 28 of each blade 3 and contoured so that it extends over the periphery of the root section and bears against the forward side of the disk when a blade root section 28 has been properly inserted in a blade 26. Adjacent edges of adjacent small coverplates 30 are shaped so that there will be no overlapping.

A full ring coverplate 32 is formed having an outwardly extending flange member 34 for positioning adjacent to and spaced from the forward part of the disk 25 and small coverplates 30. A cylindrical section 36 is connected to the inner end of the flange member 34 and positioned around the rotor shaft 13 providing an annular passageway 40.

Disk 25 has an annular flange 37 located on the forward face thereof for locating and radially supporting the flange member 34 of the full ring coverplate 32 during rotation. A plurality of projections 39, arranged in a circumferential row around the rear face of the flange member 34, engage the inner surface of the flange 37. The annular flange 37 and the projections 39 are prevented from axially engaging the flange member 34 or the disk 25, respectively, by means to be hereinafter described. The full ring coverplate 32 has a cylindrical member 38 connected to the end of the flange 34 to provide for proper positioning of the flange 34 of the full coverplate and provide for the sealing at the outer edge of the flange of the coverplate.

The cylindrical member 38 has its outer surface positioned for rotating sealing cooperation with the inner annular sealing edges 22 of annular seal member 20 to prevent leakage thereby. The rearward end of the cylindrical member 38 is positioned against the forward surfaces of the small coverplates 30 thereby holding the small coverplates 30 into sealing engagement with the forward portion of the disk 25 adjacent the slots 26 and forming a seal between the end of the cylindrical member 38 and the forward mating surface of the small coverplates 30. The cylindrical member 38 is made of a predetermined length to provide a radial passageway 41 connecting the annular passageway 40 to the inner surface of the cylindrical member 38 and prevent flange 37 from engaging the flange member 34 and the projections from engaging the disk 25.

The cylindrical section 36 is formed having an inwardly extending flange 44 which extends into a necked down portion 46 on the forward part of the rotor shaft 13. A plurality of bolt means 48 are located around the flange 44 and are bolted into a radial surface 50 on the shaft 13. It can be seen that the amount of force applied to the small coverplates 30 through the end of the cylindrical member 38 of the full ring coverplate 32 can be varied by changing the position of the bolt means 48.

The cylindrical section 36 has a second inwardly extending flange 54 adjacent flange 44 which contacts the rotor shaft 13. This flange 54 serves to guide the cylindrical section 36 on the rotor shaft 13 and also to provide a seal for the cooling fluid directed into passageway 40.

A passageway means 56 extends into the area between the cylindrical section 36 and annular seal member 20, for delivering a cooling fluid for the blades 3. Stationary seal 58 is formed between passageway means 56 and seal member 20 and rotating sealing means 57 and 59 formed between cylindrical section 36 and the passageway means 56 on both sides of passageways 60 and 62 of passageway means 56 and cylindrical section 36, respectively. Sealing means 57 and 59 include labyrinth seals of approximately the same diameter to prevent a thrust load at this point.

As the cooling fluid flows through the passageway means 56 toward the passageways 60 it is caused to assume a tangential, swirling velocity in the direction of rotation of the bladed rotor by means of a suitable spiral vane 61 forming a spiral groove. Passageways 60 are located at an angle to the radius to discharge this coolant into the passageways 62, provided in the rotor cylindrical section 36, in such a way that the coolant peripheral velocity essentially matches that of the cylindrical section. It can be seen that this feature allows an efficient transfer of the coolant into the rotor annular passageway 40, minimizing the pressure drop and temperature rise associated with more conventional means.

The cooling fluid passes from annular passageway 40 to radial passageway 41 to the area formed between the outer end of flange member 34, cylindrical member 38 and small coverplates 30. The cooling air then passes through an opening 64 in each of the small coverplates 30 which is placed in line with an opening 65 in the forward end of the root section 28 of its cooperating blade 3, where it passes into the hollow blade. The cooling air then passes through the blade and out openings adjacent the trailing edge thereof. While a blade having a single cavity 70 has been shown with a plate 72 brazed to the bottom of the blade to contain cooling air within the cavity 70, it is to be understood that blades having other types of interior cavity design can be used.

A sealing member 80 is connected to fixed structure of the engine and includes a sealing ring 82 which performs a sealing function with the rotating disk 25 and a second sealing ring 84 which cooperates with the rearward inner surface formed by the blade platforms to provide a seal.

I claim:

1. In combination in an engine, a shaft means mounted for rotation, said shaft means having rotor blades mounted thereon, a combustion section, a first fixed annular passageway means located around the shaft means is connected to said combustion section for delivering a fluid flow therefrom over the outer surface of said blades, said rotor blades having means for directing a coolant therethrough, a second fixed annular passageway means for directing a coolant axially is radially positioned outwardly from said shaft means and inwardly from said first fixed annular passageway means, said second fixed annular passageway means having a spiral passageway therein for providing a swirling action to a coolant passing therethrough, an annular chamber being positioned at the outlet of said spiral groove, first openings extending inwardly from said annular chamber towards said shaft means, said first openings extending at an angle so that the peripheral velocity of the coolant more closely matches that of the shaft means, radial openings in said shaft means for receiving coolant flow from said first openings, first seal means located between said second fixed annular passageway means and said shaft means, second seal means located between said second fixed annular passageway means and said first fixed annular passageway means, passageway means in said shaft means for directing a coolant from said radial openings to the means for directing a coolant through said rotor blades.

2. A combination as set forth in claim 1 wherein said first seal means located between said second fixed annular passageway means and said shaft means comprises a labyrinth seal on each side of said radial openings and first openings, said labyrinth seals being of approximately the same diameter.

* * * * *